US006241207B1

(12) United States Patent
Powell

(10) Patent No.: US 6,241,207 B1
(45) Date of Patent: Jun. 5, 2001

(54) POOL COVER STORAGE DEVICE

(76) Inventor: Cynthia Powell, 2515 Willard, Saginaw, MI (US) 48602

( * ) Notice: Subject to any disclaimer, the term of this patent is extended or adjusted under 35 U.S.C. 154(b) by 0 days.

(21) Appl. No.: 09/466,229

(22) Filed: Dec. 28, 1998

Related U.S. Application Data

(62) Division of application No. 08/928,911, filed on Sep. 12, 1997, now Pat. No. 5,956,783.

(51) Int. Cl.[7] ..... F16B 45/00; E04H 4/00
(52) U.S. Cl. ..... 248/304; 248/302; 4/500
(58) Field of Search ..... 248/304, 215, 248/201, 213.2, 214, 222.14, 302, 303; 4/500, 502

(56) References Cited

U.S. PATENT DOCUMENTS

| | | | | |
|---|---|---|---|---|
| 725,655 | * | 4/1903 | Beaman | 248/302 |
| 1,103,491 | * | 7/1914 | Cormier | 248/495 |
| 1,554,740 | * | 9/1925 | Licht | 248/303 |
| 1,928,995 | * | 10/1933 | De Biasi | 220/735 |
| 2,689,909 | * | 9/1954 | Dazley | 362/427 |
| 2,761,644 | * | 9/1956 | Capocci | 248/303 |
| 2,778,588 | * | 1/1957 | Capoccie | 248/112 |
| 3,252,583 | * | 5/1966 | Walther et al. | 211/119 |
| 3,707,007 | | 12/1972 | Trostler | 4/172 |
| 3,916,457 | | 11/1975 | Morita | 4/172 |
| 4,942,989 | * | 7/1990 | Miller | 224/546 |
| 4,991,238 | | 2/1991 | Forrest | 4/498 |
| 5,068,928 | | 12/1991 | Powell | 4/500 |
| 5,107,552 | | 4/1992 | Lavalliere et al. | 4/502 |
| 5,232,189 | | 8/1993 | Koch | 258/683 |
| 5,471,685 | | 12/1995 | Cross | 4/500 |
| 5,593,122 | * | 1/1997 | Robertson et al. | 248/222.12 |

* cited by examiner

*Primary Examiner*—Anita M. King
(74) *Attorney, Agent, or Firm*—John J. Swartz

(57) ABSTRACT

A one-piece device for storing a pool cover which is removed from a position covering a swimming pool, having an upstanding perimeter sidewall, to a position adjacent the sidewall. The device includes a pair of U-shaped storage members having upper legs which are integrally coupled together and cantileverly supported integral lower legs which cooperate to define an inwardly receiving opening. Mount members, which are integral with the lower legs and extend toward the upper legs, are provided for mounting the U-shaped storage members in a position in which the upper legs and at least a portion of the opening is disposed at a level above the upper end of the pool sidewall.

23 Claims, 4 Drawing Sheets

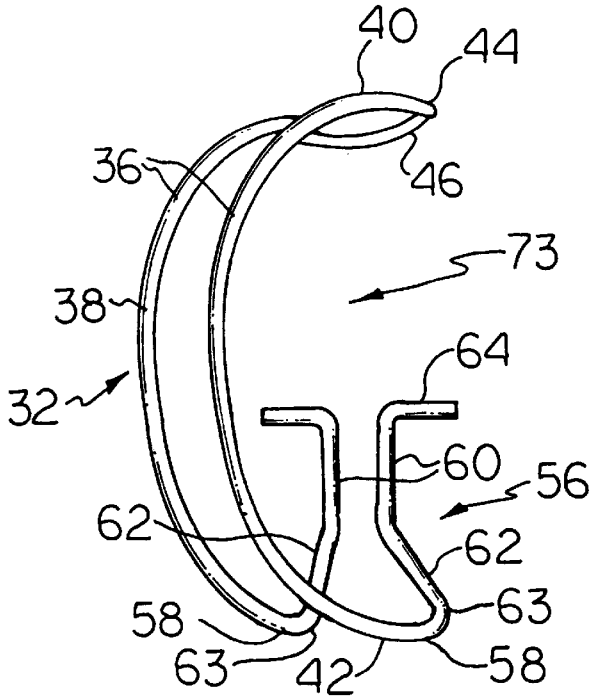
Fig 2
Fig 3
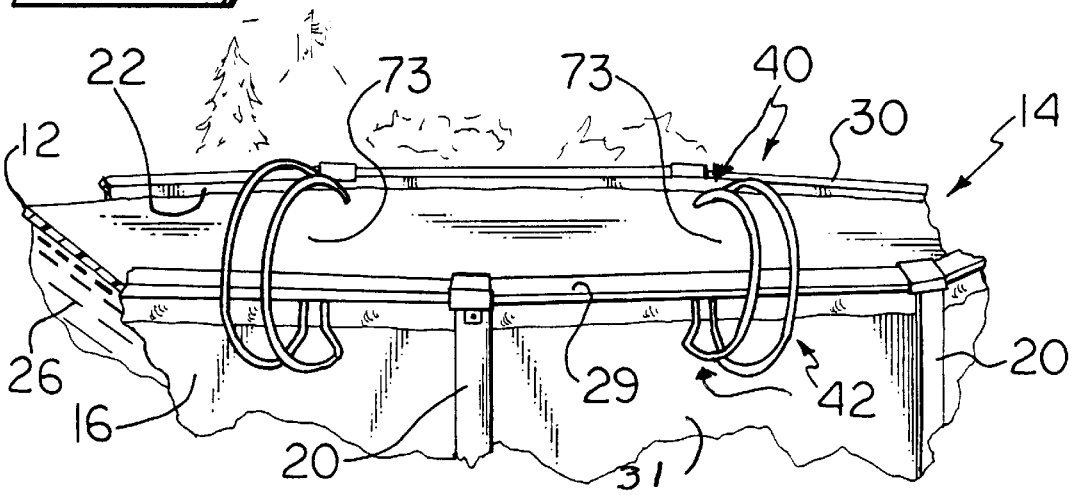

POOL COVER STORAGE DEVICE

This application is a Division of Ser. No. 08/928,911 filed Sep. 12, 1997 now U.S. Pat. No. 5,956,783.

BACKGROUND OF THE INVENTION

1. Field of the Invention

This invention relates to a pool cover storage device and, more particularly, to a device which can be mounted on a swimming pool and includes a horizontally inwardly opening receptacle that extends to a level substantially above a pool sidewall to receive and store a pool cover which is removed from a position covering an above ground pool.

2. Description of the Prior Art and Objects

Above ground swimming pools typically include an upstanding, outer perimeter sidewall and are typically covered by a removeable cover which could suitably comprise a solar cover for heating the water. Apparatus has been provided heretofore for storing a folded or rolled pool cover along the exterior sidewall of an above ground pool such as that disclosed in Applicant's prior U.S. Pat. No. 5,068,928 issued Dec. 3, 1991. The device disclosed in the aforementioned patent is cantileverly supported adjacent the upper end of the pool sidewall and includes an upwardly opening receptacle disposed alongside the sidewall into which the pool cover is deposited. It is sometimes difficult, particularly for children, to remove a pool cover stored in the prior art device as the pool cover must be vertically lifted a substantial distance out of the prior art storage device before unrolling or unfolding the pool cover prior to recovering the pool. Accordingly, it is an object of the present invention to provide a new and novel pool cover storage device which will enhance the removal of a pool cover stored therein.

It is a further object of the present invention to provide a generally U-shaped pool storage device of the type described including upper and lower legs and mount mechanism for mounting the pool storage device on a pool with the upper inner ends of the upper legs extending at a level above a pool sidewall and the inner ends of the lower legs disposed adjacent the sidewall at a level below the upper end of the sidewall.

The prior art pool cover storage device, which comprises a single strip of yieldable material, can be unstable, depending on the weight of the pool cover to be disposed therein. Accordingly, it is another object of the present invention to provide a pool cover storage device which is more stable than the prior art storage device.

It is another object of the present invention to provide a pool cover storage device which includes a horizontally inwardly opening opening for receiving a pool cover.

It is a further object of the present invention to provide a pool cover storage device including one-piece, U-shaped pool cover storage receptacle having a base with an upper leg which is disposed at a level above the upper end of a pool sidewall and a lower leg which is disposed adjacent the sidewall below the upper end of the sidewall.

Another object of the present invention is to provide a pool cover storage device constructed according to the present invention including a pair of U-shaped pool storage members each defining an opening which opens inwardly toward the pool, each of the U-shaped members including a pair of upper legs which are integrally coupled to each other and a pair of lower legs which are supported by the pool sidewall.

It is another object of the present invention to provide a pool cover storage device of the type described which is disposed at a level in which a substantial portion of the device, as well as the opening therein, extends at a level above the level of the pool sidewall for storing a substantial portion of the pool cover at a level above the level above the upper end of the sidewall.

Another problem with the prior art storage device illustrated in the aforementioned patent, is that it did not universally fit all pools because the rims or lips of the pools are of different sizes and shapes. Accordingly, it is another object of the present invention to provide pool cover storage device which can be universally mounted on above ground pools.

Other objects and advantages of the present invention will become apparent to those of ordinary skill in the art as the description thereof proceeds.

SUMMARY OF THE INVENTION

A one-piece pool cover storage device for storing a pool cover removed from a position covering a swimming pool having an upstanding, perimeter, outer sidewall, the device comprising: a U-shaped, pool cover storage receiving member having a pair of legs which define a pool cover receiving opening; and mount mechanism supporting the U-shaped member on a pool sidewall such that one of the legs, and a substantial part of the opening, is at a level above the pool sidewall and the other leg is mounted adjacent the pool sidewall.

DESCRIPTION OF THE DRAWINGS

The invention may be more readily understood by referring to the accompanying drawings, in which:

FIG. 2 is a slightly reduced, rear end perspective view of the pool storage device only;

FIG. 3 is a further reduced, rear end perspective view illustrating a plurality of the pool cover storage devices mounted on a pool;

DESCRIPTION OF PREFERRED EMBODIMENT

Figure 1:
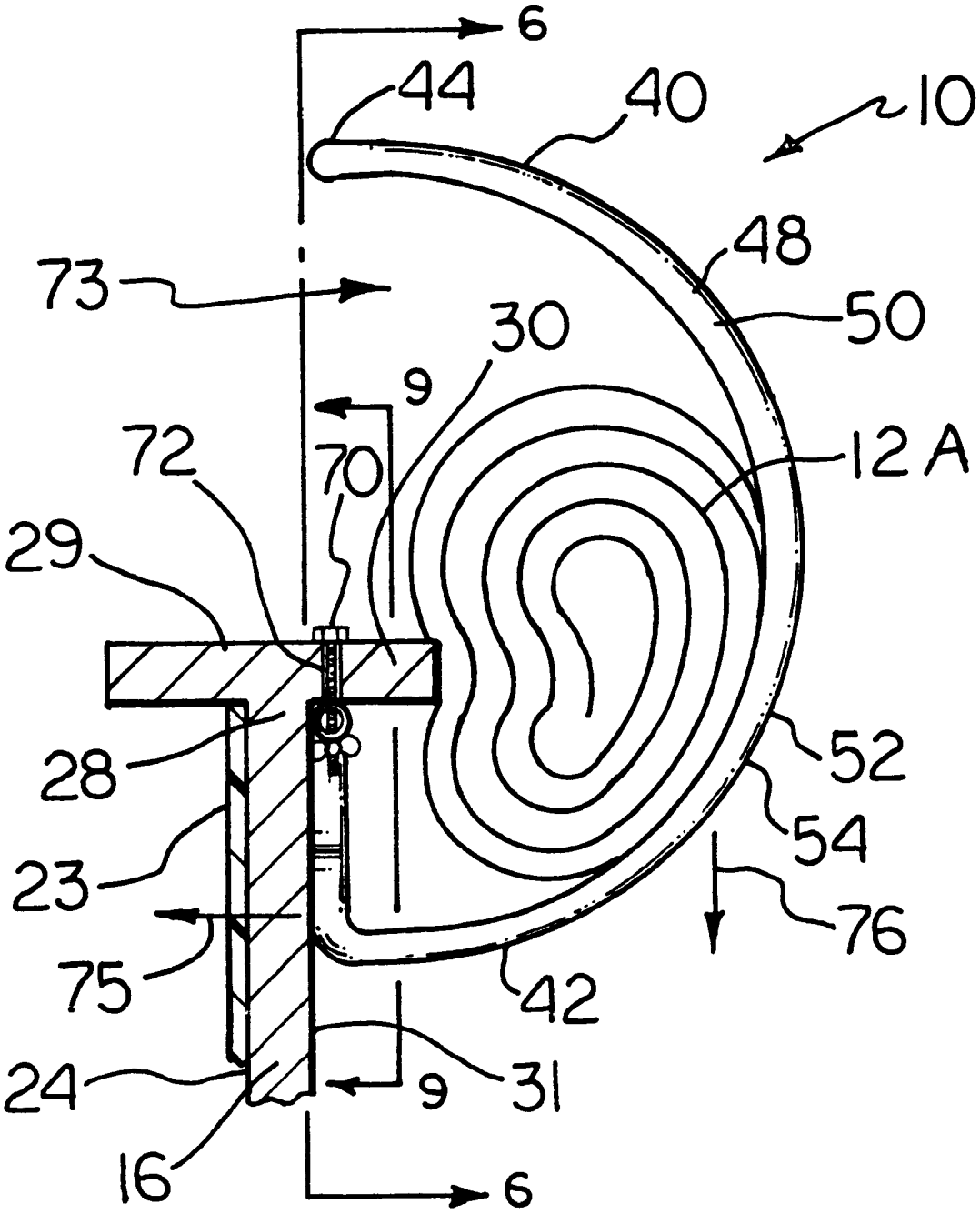
FIG. 1 is a sectional side view taken along the section line 1—1 of FIG. 6, illustrating a pool storage device, constructed according to the present invention, supported by a pool sidewall.

A pool storage device, generally designated 10, constructed according to the present invention, is provided for storing a pool cover, generally designated 12, utilized to cover an above ground swimming pool, generally designated 14. The pool 14 includes an upstanding, outer perimeter annular, endless wall, generally designated 16, supported about its circumference via a plurality of circumferentially spaced apart, upstanding posts 20. A cup shaped water impervious liner 22 lines the inside of the pool 12 and includes an upstanding wall portion 23 disposed against the inner surface 24 of the wall 16 for holding water, generally designated 26. The upper end portion 28 of the upstanding outer wall 16 mounts an inwardly and outwardly extending flange, rim, or step 30 utilized as a support for gaining access to the water 26 inside the pool. The cover 12 floats on the surface of the water 26 (FIG. 3) to prevent dirt, leaves, debris and other air-born foreign matter from entering the pool water 26. The cover 12 may suitably comprise a solar cover for heating the pool water. The cover 12 is folded or rolled from a generally planar, pool covering position, illustrated in FIG. 3, to a removed, stowed position, illustrated in FIGS. 1, 4 and 5.

Figure 4:
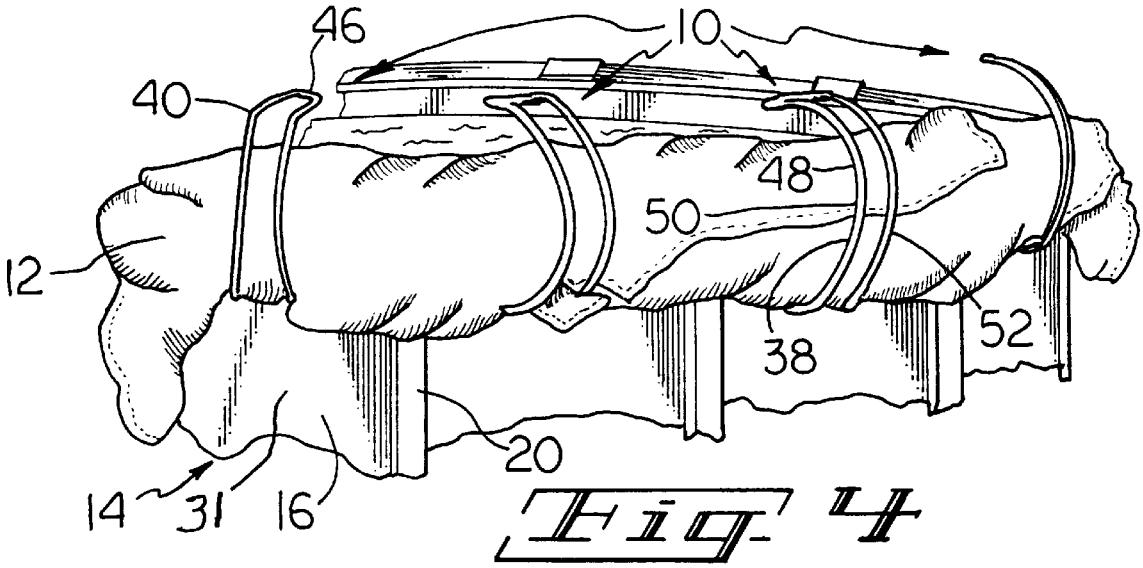
FIG. 4 is a further reduced rear end perspective view illustrating a plurality of pool storage devices, supported by the sidewall of an above ground swimming pool supporting a pool cover.
Figure 5:
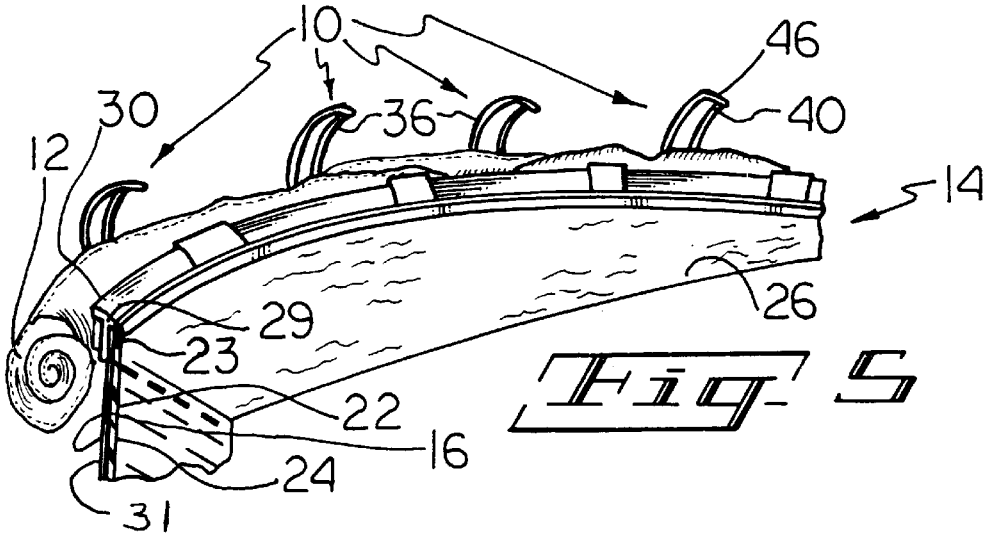
FIG. 5 is a further reduced, opposite front end perspective view illustrating the pool cover stored disposed in a plurality of the pool cover storage devices supported by a pool sidewall.

As illustrated in FIGS. 3, 4 and 5, a plurality of perimetrically spaced apart pool storage devices 10 are mounted on the pool 14 adjacent the outside surface 31 of the pool side wall 16. Each pool storage device 10 may suitably comprise a one-piece strip 32 of yieldable plastic material, which is formed in the shape illustrated. The device 10 includes a pair of inwardly opening, laterally spaced apart generally U-shaped, side-by-side, generally coextensive pool cover receiving members, generally designated 36, each including an upstanding base portion 38 and a pair of integral, upper and lower legs, generally designated 40 and 42, respectively. The upper legs 40 include inner confronting ends 44 which are spanned by an integral yieldable coupling member or base 46 which is disposed at a level substantially above the upper wall end 28 and the step 30. The upper legs 40 include outer confronting ends 48 which are integral with the upper end 50 of the base members 38. The lower ends 52 of the base members 38 are integral with the outer ends 54 of the lower legs 42 to cantileverly and yieldably support the legs 42 thereon for limited movement relative to each other between closed positions, illustrated in FIG. 8, and spread positions, illustrated in FIG. 9.

A pair of mount members, generally designated 56, are integrally coupled to the inner confronting ends 58 of the lower legs 42 for mounting each pool cover storage device 10 on the pool laterally outwardly adjacent the upper end 28 of the sidewall 16. Each of the mount members 56 is generally upstanding and includes a linear vertical portion 60 for bearing against the upper end 28 of the outside surface 31 of the sidewall 16 and an integral, lower angled portion 62 which, at its lower end 63, is integral with an inner end 58 of one of the lower legs 42. The lower angled portions 62 diverge laterally outwardly in a downward direction. The mount members 56, which extend upwardly toward the inner leg ends 44 and upper base 46, also each include an upper laterally offset terminal end portion 64 which extends transversely and in perimetrically opposite directions relative to each other. The upper offset portions 64 are coupled to the underside 68 of the upper step 30 via suitable bolt fasteners 70 which pass through aligned apertures 72 and 74 in the step 30 and offset members 64, respectively.

Figure 6:
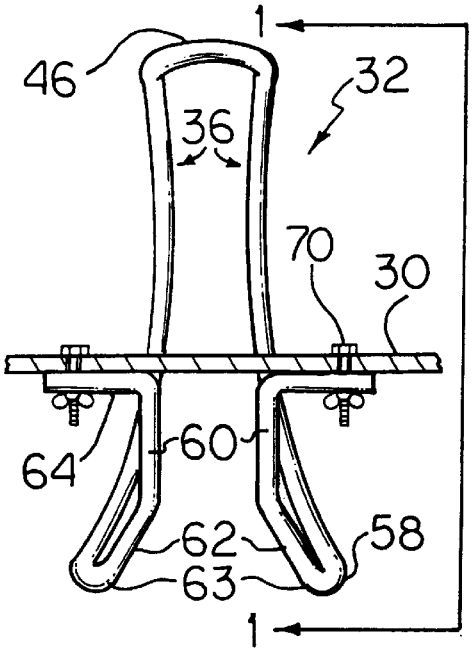
FIG. 6 is a front end sectional view, more particularly illustrating one of the pool storage devices, taken along the section line 6—6 of FIG. 1.
Figure 7:
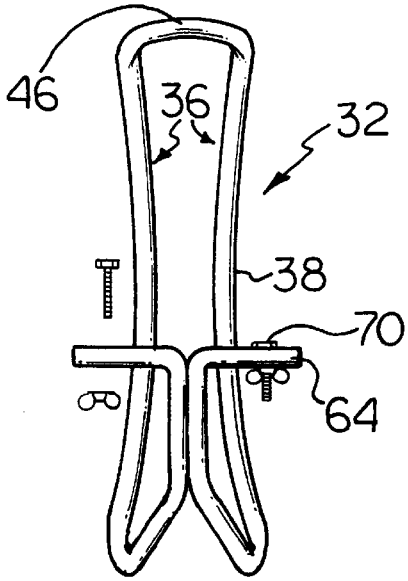
FIG. 7 is a front end view, similar to FIG. 6, illustrating only one of the pool storage devices in a relaxed condition prior to mounting on the pool.
Figure 8:
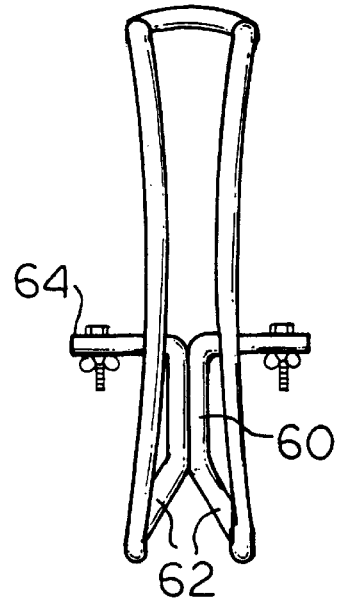
FIG. 8 is a rear end elevational view of the pool storage device illustrated in FIG. 7.

When the pool cover storage device 10 is not mounted, the yieldable coupling member or base 46 urges the linear mount portions 60 into abutting relation, as illustrated in FIGS. 7 and 8. The yieldable base 46 allows the pool cover receiving members 36, when mounted on the pool 14 to spread apart to the spaced apart positions illustrated in FIG. 6.

The upper and lower legs 40 and 42 define an inwardly opening opening or receptacle, 73 for receiving the cover 12 when the cover 12 is rolled, folded and/or otherwise removed from a position covering the pool 14, as illustrated in FIG. 3 to an uncovered stowed position illustrated in FIGS. 1, 4 and 5.

A substantial portion of the pool storage device 10 is disposed above the upper terminal end 29 of the sidewall 16 and the step 30 so that when the pool cover 12 is withdrawn from the pool cover storage unit 10, it need not be lifted vertically any substantial distance and yet, holds the cover 12 outwardly of the pool sidewall 16. The device 10 is adaptable to being universally mounted on any one of a plurality of different shaped pool designs and is not restricted to a single pool design.

The mount members 58 serve as a brace which bears against the outer pool wall surface 32 as the additional weight of the pool cover 12 is supported by the device 10 and tends to move the device 10 downwardly in the direction of the arrow 76. The lower end of the vertical portion 60 will bear against the inside surface 32 as represented by the arrow 75. Accordingly, substantial force is absorbed by the sidewall 16.

THE OPERATION

A plurality of pool storage devices 10 is mounted in circumferentially spaced apart position on the pool 14 via the bolts 70 which are coupled to wall supported step 30 to provide a plurality of inwardly opening receptacles or openings 73 having a substantial portion thereof disposed at a level above, the pool wall 16 and the step 30.

The upstanding linear mount portions 60 are generally parallel and are spread, before mounting, from the abutting positions, illustrated in FIGS. 7 and 8 to the spread positions, illustrated in FIGS. 2 and 6. The lower angled portions 62 diverge laterally outwardly in a downward direction.

Figure 9:
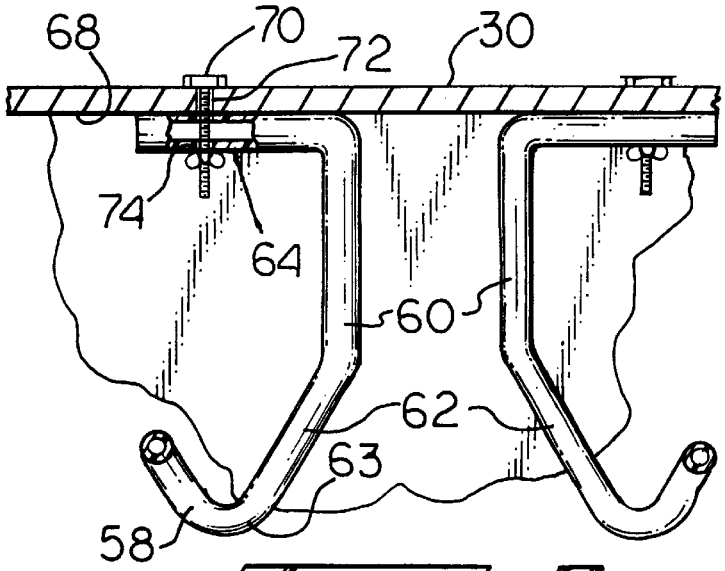
FIG. 9 is a front end sectional view taken along the line 9—9 of FIG. 1.

The base or coupling member 46 spanning the upper inner ends 44 of the U-shaped members 36 comprise yieldable plastic material which urges the U-shaped members 36 together to the positions illustrated in FIGS. 7 and 8 but is yieldable to allow the legs to be spaced apart when mounted as illustrated in FIGS. 2, 6 and 9. The spreading of the U-shaped members 36 against the force of yieldable member 46 tending to move them together, rigidifies the structure by laterally increasing the spacing between the bases 38 and tends to prevent spinning of the members 36 about the bases 38.

The vertical linear portion 60 of the mount member 58 bears against the outer wall surface 32.

Typically, the user will enter the pool and roll the cover 12 into a roll, generally designated 12A, moved to a position outwardly of the pool sidewall 16 received by the opening 73. The weight of the pool cover 12 will tend to move the unit 10 downwardly and swing the device 10 about the bolt fasteners 70. The mount members 58 will bear against the sidewall 32 and preclude swinging movement thereof. The vertical legs 60 operate as a knee or brace which bears against the outer surface 32 of the pool sidewall to preclude the device from swinging inwardly when the pool cover is disposed therein.

The pool cover 12, when stowed in the position illustrated in FIG. 1, can be easily removed though the opening 73 without substantial lifting force, when the pool cover 12 is to be repositioned on the pool, as illustrated in FIG. 2.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. A one-piece pool cover storage device for storing a pool cover which is removed from a position covering a pool, having an upstanding side wall with inner and outer sides, to a removed position, said pool cover storage device comprising:

a pair of laterally spaced apart, generally U-shaped pool cover storage members each including a base, upper and lower legs each having inner and outer ends, said outer ends being integrally coupled to said base and defining a horizontally inwardly opening opening for receiving the pool cover;

coupling means integrally spanning said inner ends of said upper legs and cantileverly supporting said inner ends of said lower legs; and mounting means, integrally coupled to each of said inner ends of said lower legs including an upstanding portion extending toward said coupling means, for only bearing against the outer side of the pool side wall.

2. A one-piece pool cover storage device for storing a pool cover which is removed from a position covering a pool, having an upstanding side wall with inner and outer sides and an upper end, to a removed position, said pool cover storage device comprising:

a pair of laterally spaced apart, generally U-shaped pool cover storage members each including a base, upper and lower legs each having inner and outer ends, said outer ends being integrally coupled to said base and defining a horizontally inwardly opening opening for receiving the pool cover;

coupling means integrally spanning said inner ends of said upper legs, for hingedly coupling said U-shaped pool cover storage members and allow said inner ends of said lower legs to move relative to each other; and mounting means, integrally coupled to each of said inner ends of said lower legs, for extending toward said coupling means only along the outer side of the sidewall and only below the upper end of the sidewall for mounting the U-shaped pool cover storage members on the pool side wall.

3. The one-piece pool cover storage device set forth in claim 2 wherein each of said mounting means comprises an upstanding portion including an upper end and a lower end, each of said mounting means including a lower portion coupled to said lower end of said upstanding portion and diverging downwardly outwardly relative to the other lower portion.

4. The one-piece pool cover storage device set forth in claim 3 wherein each of said mounting means includes an upper, laterally outwardly offset terminal end integral with said upper end of said upstanding portion.

5. A one-piece pool cover storage device for storing a pool cover removed from a position covering a swimming pool having an upstanding, perimetrically extending outer sidewall provided with an upper end, inner sides and outer sides, said device comprising:

horizontally inwardly opening pool cover storage means for storing the pool cover on the outer side of the sidewall including an upper pair of laterally spaced apart legs each having inner and outer ends, a lower pair of laterally spaced apart legs each having inner and outer ends, a pair of intermediate bases integral with the outer ends of said upper and lower pairs of legs, and yielding means, integral with said inner ends of said upper pair of laterally spaced apart legs, for yieldably urging said upper pair of legs toward each other and said lower pair of legs toward each other but allowing said upper pair of legs to be spread apart and allowing said lower pair of legs to be spread apart to spread positions;

said upper and lower pairs of laterally spaced apart legs and said pair of intermediate bases cooperating to define a horizontally inwardly opening opening for detachably receiving the pool cover removed from a position covering the swimming pool; and mounting means, integrally coupled to said inner ends of said lower pair of legs and extending in a direction toward said inner ends of said upper pair of legs, for mounting said lower pair of legs in said spread positions on the outer sidewall of the pool and dispose said inner ends of said upper pair of legs at a level above the inner ends of said lower pair of legs.

6. The pool cover storage device set forth in claim 5 wherein said mounting means includes an upstanding mount portion, integrally coupled to each of said inner ends of said lower legs, extending in a direction toward said inner ends of said upper legs.

7. The pool cover storage device set forth in claim 6 wherein each of said upstanding portions includes a vertical linear portion having upper and lower ends, a downwardly outwardly extending angled portion integral with said lower end of said vertical linear portion and integral with one of said inner ends of said lower legs.

8. The pool cover storage device set forth in claim 7 wherein each of said upstanding mount portions includes a generally horizontal, offset terminal end portion integral with said upper end of vertical portion.

9. A one-piece device for storing a pool cover which is removed from a position covering a swimming pool, having an upstanding perimeter sidewall with inner and outer sides and an upper end, to a stowed position adjacent the upper end of the sidewall, said device comprising:

a base having opposite ends;

a pair of U-shaped cover receiving members each defining an opening for receiving the pool cover in said stowed position, each of said members having a first end integral with, but yieldably coupled to, one of said opposite ends of said base, and a second end;

said second ends being cantileverly and yieldably supported on said first ends for limited movement toward and away from each other; and mounting means integral with said second ends of said U-shaped cover receiving members, for mounting said U-shaped cover receiving members on the sidewall such that said base, said first ends and a substantial portion of said opening, are disposed at a level above said second ends and said opening is inwardly disposed.

10. The one-piece device set forth in claim 9 wherein said mounting means extends in a direction toward said base.

11. The one-piece device set forth in claim 10 wherein said mounting means includes a pair of mount members each having a linear portion for bearing against the outer side of the sidewall.

12. The one-piece device set forth in claim 11 wherein said mount members each include an upper offset end portion integral with said linear portion, said upper offset end portions of said pair of mount members extending in opposite directions from said linear portions.

13. The one-piece device set forth in claim 12 wherein said mount members each include an angled portion integrally coupled to one of said linear portions and integrally coupled to one of said second ends of said U-shaped cover receiving members, said angled members diverging away from each other in a direction away from said linear portions.

14. The one-piece set forth in claim 13 wherein said base comprises yielding hinge means urging said second ends of said U-shaped cover receiving members toward each other but allowing relative movement of said second ends away from each other.

15. A one-piece pool cover storage device for detachably storing a pool cover which is removed from a position covering a swimming pool, having an upstanding perimeter sidewall provided with an upper end and inner and outer sides, to a stowed position adjacent the upper end of the sidewall, said pool cover storage device comprising:

a pair of side-by-side, generally upstanding and generally coextensive, U-shaped pool cover storage members, defining an opening for receiving the pool cover in the stowed position;

each of said U-shaped members having upper coupling ends and lower free terminal ends disposed in confronting relation with said upper coupling ends and said lower terminal ends, respectively, of the other of said U-shaped members;

said first ends being spaced apart from each other;

a coupling member integrally coupling said first ends of said pair of U-shaped storage members together and cantileverly supporting said second ends thereon independently of each other; and first and second independent mounting members integrally coupled to said lower free terminal ends and extending toward said coupling member for mounting said pool cover storage members on the outer side of the sidewall with said coupling member disposed at a level above said mounting members.

16. The one-piece pool cover storage device set forth in claim 15 wherein said coupling members comprises yielding hinge means urging said U-shaped pool cover storage members, including said lower terminal ends, toward each other but yieldably allowing spreading movement of said U-shaped pool cover storage members and said terminal ends to spread positions spaced from each other.

17. A one-piece pool cover storage device for receiving a pool cover detached from a position covering a pool which includes an upstanding pool sidewall having an upper end provided with an outer surface, said device comprising:

first and second legs each having inner and outer ends;

a base integrally coupled to said outer ends of said first and second legs so as to dispose said inner ends of said first and second legs in vertically spaced relation to define an opening there-between for receiving the pool cover;

said inner ends of said first leg being cantileverly freely supported on said base; and means, integrally coupled to said inner end of said first leg, for mounting said first leg on only the outer surface of the pool sidewall with said inner end of said first leg disposed outwardly adjacent the outer surface of the sidewall at a level in which said inner end of said first leg is below the level of said inner end of said second leg.

18. The one-piece pool cover storage device set forth in claim 17 wherein said first leg comprises an upper pair of laterally spaced apart leg members each having inner and outer end portions, said second leg comprises a lower pair of laterally spaced apart leg members each having inner and outer end portions, and yielding means integrally coupled to said inner end portions of said upper pair of laterally spaced apart leg members.

19. The one-piece pool cover storage device set forth in claim 18 wherein said means for mounting comprises a mount member integrally coupled to each of said inner end portions of said lower leg members and extending upwardly toward said inner end portions of said upper leg members.

20. The one-piece pool cover storage device set forth in claim 19 wherein said mount member includes a vertical, upper mount section having upper and lower end portions, a lower, downwardly inclined section integrally coupled to said lower end portion and one of said inner end portions of said lower leg member and a transversely disposed, offset terminal end section integrally coupled to said upper end portion of said vertical, upper mount section.

21. A one-piece pool cover storage device for storing a pool cover which is removed from a position covering a pool, having an upstanding side wall with inner and outer sides, to a removed position, said pool cover storage device comprising:

a pair of laterally spaced apart, generally U-shaped pool cover storage members each including a base, upper and lower legs each having inner and outer ends, said outer ends being integrally coupled to said base and defining a horizontally inwardly opening opening for receiving the pool cover; and coupling means spanning said inner ends of said upper legs; and mounting means integrally coupled to each of said inner ends of said lower legs including an upstanding portion extending toward said coupling means for bearing against the outer side of the pool side wall;

said coupling means spanning said inner ends of said upper legs comprising yielding means urging said U-shaped pool cover storage members toward each other to closed positions but allowing said U-shaped pool cover storage members to spread apart to spread positions rigidifying said U-shaped pool cover storage members.

22. The one-piece pool cover storage device set forth in claim 21 wherein said upstanding portions of said mounting means are in abutting relation when said U-shaped members are in said closed positions and in spaced apart positions when said U-shaped members are in said spread positions.

23. A one-piece device for storing a pool cover which is removed from a position covering a swimming pool, having an upstanding perimeter sidewall provided with inner and outer sides, to a stowed position adjacent an upper end of the sidewall, said device comprising:

a base having opposite ends;

a pair of U-shaped cover receiving members each defining an opening for receiving the pool cover in the stowed position, each of said members having a first end integral with one of said opposite ends of said base, and a second end; and mounting means, integral with said second ends of said U-shaped cover receiving members and extending in a direction toward said base, for mounting said U-shaped cover receiving members on the outer side of the sidewall with said base, and a substantial portion of said opening, disposed at a level above said mounting means and said opening being inwardly disposed;

said mounting means including a pair of mount members each having a linear portion for bearing against the sidewall; and, an upper offset end portion, integral with said linear portion;

an angled portion integrally coupled to said linear portion and integrally coupled to one of said second ends of said U-shaped cover receiving members;

said angled portions of said pair of mount members diverging away from each other in a direction away from said linear portions;

said upper offset end portions of said pair of mount members extending in opposite directions from said linear portions; and said base comprising yielding means urging said second ends of said U-shaped cover receiving members toward each other but allowing relative movement of said second ends away from each other.

* * * * *